US006431673B1

(12) United States Patent
Heim et al.

(10) Patent No.: US 6,431,673 B1
(45) Date of Patent: Aug. 13, 2002

(54) INK LEVEL GAUGING IN INKJET PRINTING

(75) Inventors: Rory A. Heim, Corvallis; Steven T. Castle, Philomath, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 39 days.

(21) Appl. No.: 09/655,180

(22) Filed: Sep. 5, 2000

(51) Int. Cl.[7] ..... B41J 2/795; B41J 29/38; B41J 29/393

(52) U.S. Cl. ..... 347/9; 347/7; 347/14; 347/19

(58) Field of Search ..... 347/7, 14, 19, 347/9

(56) References Cited

U.S. PATENT DOCUMENTS 5,315,316 A 5/1994 Khormaee ..... 347/3
5,583,547 A 12/1996 Gast et al. ..... 347/22
5,644,343 A 7/1997 Allen ..... 347/17
5,655,174 A * 8/1997 Hirst ..... 399/27
5,721,573 A * 2/1998 Benjamin ..... 347/7
5,788,388 A 8/1998 Cowger et al. ..... 400/703
5,793,388 A 8/1998 Martinson et al. ..... 347/19
6,019,449 A * 1/2000 Bullock et al. ..... 347/14

* cited by examiner

*Primary Examiner*—John Barlow
*Assistant Examiner*—Alfred E. Dudding

(57) ABSTRACT

The gauging method generally follows a drop count approach to ink level gauging while making more precise the relationship between the expelled-drop count and the weight of ink actually expelled, thereby to provide more accurate ink level gauging. The printhead temperature is monitored as each swath of an image is printed. Moreover, temperature variations that occur within each swath are noted so that the corresponding intra-swath variations in drop weight are factored into the calculation of a net ink drop weight that more closely approximates the drop weight actually ejected. The method also factors in the effect that printing frequency has on drop weight.

20 Claims, 4 Drawing Sheets

INK LEVEL GAUGING IN INKJET PRINTING

TECHNICAL FIELD

This invention relates to gauging the level of ink in an inkjet print cartridge by precisely determining the amount of ink that is ejected from a cartridge during printing.

BACKGROUND AND SUMMARY OF THE INVENTION

An ink-jet printer typically includes one or more print cartridges that contain ink. In some designs, the cartridge has discrete reservoirs of more than one color of ink. Each reservoir is connected by a conduit to a printhead that is mounted to the body of the cartridge. The reservoir or supply of ink may be carried in the cartridge or remote from the cartridge. When a remote supply is used, the ink is delivered from the remote supply to the cartridge by a flexible tube to fill an intermediate reservoir adjacent to the printhead.

The cartridge is controlled for ejecting minute drops of ink from the printhead to a printing medium, such as paper, that is advanced through the printer. The ejection of the drops is controlled so that the drops form recognizable images on the paper. The cartridge is mounted to a carriage that scans across the medium as drops are ejected.

One can consider the portion of the print medium that is traversed by a printhead for receiving ink from the print head as a print swath. Between carriage scans, the paper is advanced so that the next swath of the image may be printed. Oftentimes, especially for color images, the carriage is scanned more than once across the same swath. With each such scan, a different combination of colors or droplet patterns may be printed until the printed swath is complete.

With thermal-type inkjet printers the printhead includes several resistors that are selectively driven (heated) with pulses of electrical current. The heat from each driven resistor is sufficient to form a vapor bubble in ink that fills an ink chamber that surrounds the resistor. The rapid expansion of the vapor bubble ejects or "fires" an ink drop through a nozzle that is associated with the ink chamber. The chamber is refilled after each drop ejection with ink that flows into the chamber through a channel that connects with the conduit to the reservoir ink. Each printhead has numerous chambers and nozzles.

It is important to properly gauge the amount of ink remaining in a print cartridge. In this regard, it is best to replace a nearly empty cartridge with a full or nearly full one before a large (in terms of ink density) print operation is started. That is, print quality may suffer if a print cartridge is replaced during a printing task. Also, the printhead itself can fail and be damaged if it were operated (that is, driven with current pulses) after the supply of ink was depleted by an amount such that the ink chambers surrounding the resistors no longer filled. This printhead-damaging situation is characterized as "dry firing."

Given the importance of accurately gauging ink levels, there have been provided in the past numerous attempts to monitor the amount of ink remaining in a supply or reservoir. For example, an optical sensor may be positioned near a transparent portion of an ink supply and configured to produce a signal when the light transmissive characteristics of that portion change in a manner that indicates the supply is nearing empty. The signal is converted to a human perceptible warning or notice ("Low-on-Ink" "Out-of-Ink," etc) for indicating that the supply should be replaced.

However a low-on-ink or out-of-ink signal is produced, the printer is usually controlled so that a small amount of ink is reserved in the supply once an out-of-ink condition is reached. This reserve may be enough to enable the printer to complete printing of a sheet (rather than stopping during printing of a sheet) and "limp home" to a service station carried in the printer. In any event, the reserve is large enough to ensure that no printhead dry firing occurs.

In one approach to gauging the amount of ink remaining in a supply or reservoir, the printer controller keeps track of the number of drops fired from the printhead and periodically updates a memory structure that initially reflects the amount of ink in a full cartridge. For example, a new cartridge would be characterized at the time of manufacture as having a given amount of ink, preferably measured in units of weight. A printer controller is provided (as by associated firmware) with this initial weight. As drops are fired, the printer controller accumulates the drop count and converts that count to a corresponding weight of expelled ink. This amount is subtracted from the initial weight of ink in the cartridge, and an appropriate warning signal is produced when the remaining weight is depleted by an amount indicting the printer is low on ink or out of ink.

The present invention generally follows the "drop count" approach to ink level gauging and is directed to a method of making more precise the relationship between the expelled-drop count and the weight of ink actually expelled, thereby to provide more accurate ink level gauging.

By making the gauging more precise, the amount of reserve ink (which can be thought of as a safety factor) can be reduced, which leads to less wasted ink when a user replaces a cartridge. An attendant advantage to this is the production of more printed pages per cartridge.

The present invention may be used to supplement other ink level gauging approaches (such as the optical monitoring mentioned above), or as a stand-alone technique for precisely monitoring the level of ink in the cartridge.

The temperature of an operating printhead can vary considerably as a swath is printed. This variation in temperature is primarily due to the amount of ink that is printed (the print density) within the swath. Thus, when a portion of an image requires lots of ink, the printhead operating temperature will rise. As the printhead temperature increases, the weight of each expelled drop (that is, the "drop weight") also increases. Put another way, temperature changes from a normal or set point printhead operating temperature will cause changes in the drop weight that must be accounted for in gauging the amount of remaining ink. Generally, as the temperature increases, the drop weight increases.

As one aspect of the present invention, the printhead temperature is monitored as each swath of the image is printed. Moreover, temperature variations that occur within each swath are noted so that the corresponding intra-swath variations in drop weight are factored into the calculation of a "net" ink drop weight that more closely approximates the drop weight actually ejected.

The method of the present invention also factors in the effect that printing frequency has on drop weight. The printing frequency is the rate with which inks drops are ejected and is measured in cycles, such as hertz (Hz). Generally, the ejected drop weight decreases as the printing frequency increases. As with temperature, printing frequency may vary considerably during printing of a swath. The present invention accounts for this intra-swath variation of printing frequency.

At some printing frequencies the effects of temperature changes on drop weight are much more pronounced than at other printing frequencies. Conversely, drop weights may not vary significantly with printing frequency changes within certain ranges of frequencies. Consequently, it is contemplated that the method of the present invention may, in some instances, account for only printhead temperature changes or only frequency changes. Normally, however, both temperature and frequency will be considered.

As another aspect of the present invention, the determination of ejected drop weight also accounts for drop weight variations that are attributable to normal use over the life of the printhead. That is, a printhead has a useful life that may be measured in tens of millions of ejected drops and, with other factors being equal, the average drop weight tends to increase during the life of the printhead. The drop weight variation over the life of the printhead is considered in the present invention.

As another aspect of the present invention, the method maintains information (preferably on the print cartridge) relating to the difference between the initial weight of a full cartridge and the net weight of the ink ejected from the cartridge. In other words, the ink level or amount of remaining ink is maintained in memory and made available for display to the user of the printer. This ink level is also adjusted from time to time to account for ink depletion resulting from evaporation.

The invention is primarily embodied in a printer control algorithm of a printing system that includes mechanisms (processor, temperature sensors, drop counters, display, etc) for efficiently performing the algorithm so that ink level data is continuously and precisely gauged and made available to the user.

Apparatus and methods for carrying out the invention are described in detail. Other advantages and features of the present invention will become clear upon review of the following portions of this specification and the drawings.

DETAILED DESCRIPTION OF PREFERRED EMBODIMENTS

Figure 1:
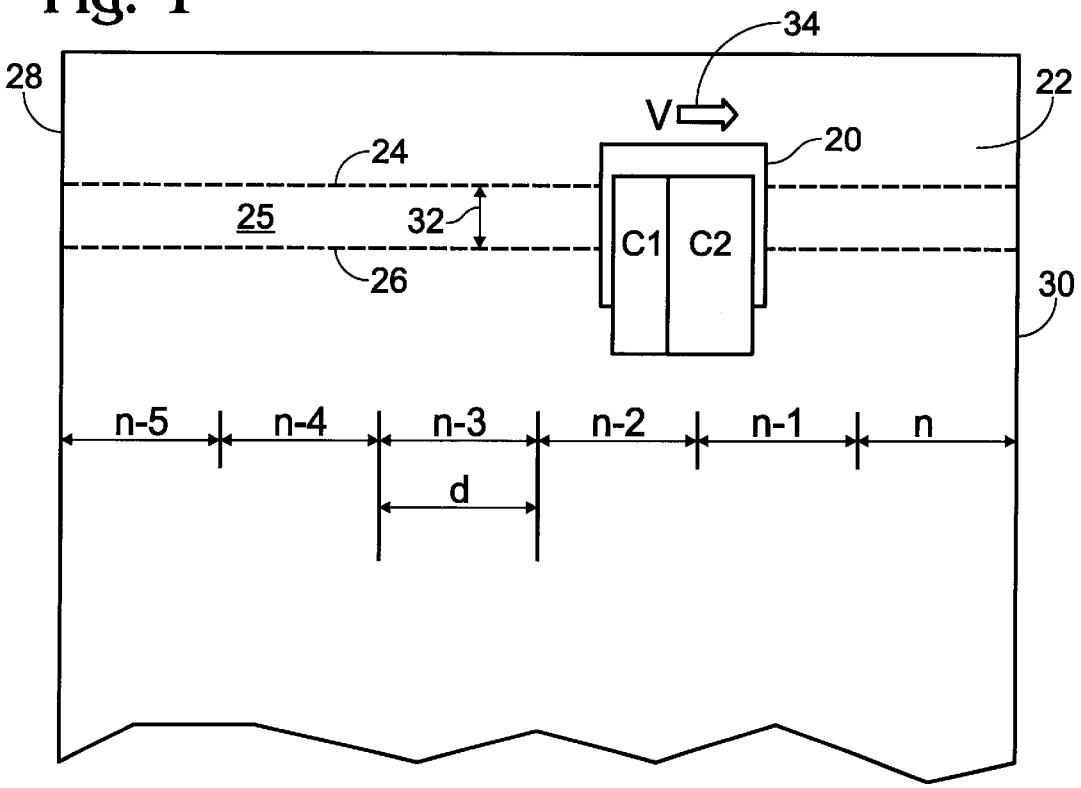
FIG. 1 is a diagram for illustrating print cartridges traversing a swath that is divided into a number of intervals to facilitate ink level gauging in accordance with the method of the present invention.

The diagram of FIG. 1 illustrates generally from above, a pair of inkjet print cartridges C1 and C2 that are mounted to a carriage 20 for reciprocating translational motion across the width of a sheet of print medium, such as paper 22. As the cartridges are moved, printheads that are attached to them are operated for selectively ejecting ink drops to form an image on the paper 22.

The scanning-type printer of interest here prints one swath at a time. A swath 25 is illustrated in FIG. 1 as the region between the imaginary, parallel dashed lines 24, 26. Thus, in this exemplary embodiment, the cartridges C1, C2 are moved by the carriage 20 from one side 28 of the paper 22 to the other side 30 as ink drops are ejected from the printheads onto the swath 25.

One or more columns of minute nozzles are formed in the cartridge printheads. The nozzles are oriented to extend in a direction parallel to the dimension line 32. One or all of the nozzles in a column of nozzles may be fired. That is, the resistor associated with that particular nozzle is heated to eject an ink drop from the surrounding ink chamber and through the nozzle. Thus, the dimension line 32 defines the swath width over which ink drops may be expelled as the carriage traverses the medium.

The swath width 32 illustrated in FIG. 1 may also be characterized in terms of the maximum number of nozzles extending across the width of the swath, normal to the direction of carriage travel (arrow 34 in FIG. 1). This characterization is useful for determining the printing frequency as described more below. The total number of these "swath-width nozzles" may vary from one model of print cartridge to another.

For illustrative purposes, two separate cartridges C1, C2 are shown in the figures. One cartridge, C1, is intended to represent a black-ink cartridge. The other cartridge, C2, represents a three-compartment cartridge that holds cyan, yellow, and magenta-colored ink. It will be appreciated that the present invention may be carried out with a single cartridge, or with more than two cartridges. For instance, some color printers use four cartridges at a time, each cartridge carrying a particular color of ink, such as black, cyan, yellow, and magenta. In the present description, the term "cartridge" is intended to mean any such device for storing liquid ink and for printing drops of the ink to media. Also, the cartridges may be connected to remote sources of ink that supplement the ink supply that is stored in each cartridge.

For the purposes of this description, reference often will be made primarily to one cartridge C1, with the understanding that, unless otherwise stated, the particulars of the preferred embodiment (temperature sensing etc) also apply to the other cartridge C2.

Figure 2:
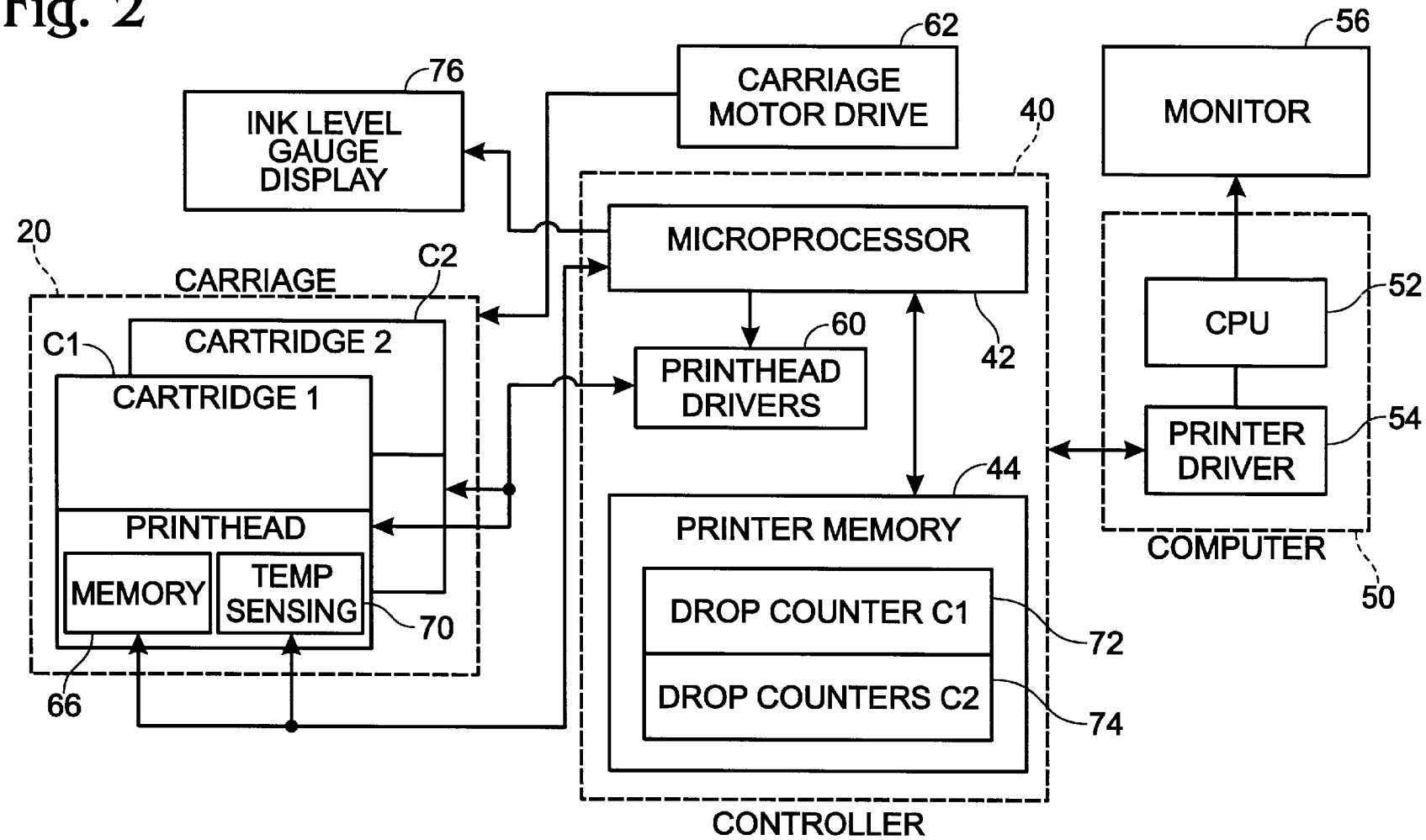
FIG. 2 is a block diagram of a printer system adapted for carrying out the method of the present invention.

As illustrated in the block diagram of FIG. 2, the pertinent aspects of a printer system for carrying out the present invention includes a printer controller 40 that comprises a microprocessor 42 (and associated conventional clock, registers, etc.) and memory 44. In this embodiment, a computer 50 is connected to the printer and includes at least a central processing unit 52, printer driver 54, and monitor 56. Print data corresponding to an image to be printed is transmitted from the computer 50 to the printer controller 40 in conventional fashion. The microprocessor 42 processes the print data to produce raster data that is stored in the printer memory 44.

The print data is transferred to printhead drivers 60 in segments for conversion to current pulses that selectively drive the resistors in the printheads to eject ink drops in accord with the print data. In addition, the microprocessor 42 of the print controller drives a carriage motor 62, and the ink drop ejection from the printhead nozzles is coordinated with the scanning motion of the cartridges across the swath 25.

In accordance with the present invention, each cartridge C1, C2 is provided with a memory chip 66 that is preferably integrated on the printhead. In one preferred embodiment, the memory chip includes non-volatile RAM (NVRAM) and thus includes an EEPROM that may be read and written to by the printer controller 40 as described more below.

Each cartridge memory chip 66 includes factory-recorded information, such as cartridge type (model and/or ink color), weight of ink (i.e., for a new, full cartridge), date of manufacture, out-gassing or vapor transmission rate, average ink drop weight when the printhead is new, and a table or mathematical function that shows expected drop weight changes over the life of the printhead. Part of the memory chip 66 has two 8-bit counters for storing with the cartridge the changing ink level data, as described more below.

The printer memory 44 includes firmware or ROM that stores tables or mathematical functions relating, for a particular type of printhead, variations in drop weight to changes in printhead temperature, and relating variations in drop weight to changes in printing frequency. The printhead type is read by the controller 40 from the memory chip 66 of an installed cartridge. Other information stored in the printer memory may include, for various printhead types, the temperature set point that is considered to be the normal operating temperature for the printhead.

It will be appreciated by one of ordinary skill in the art that much of the information stored in the printhead memory chip 66 can alternatively be stored in the printer memory 44, or vice versa. At least the printhead type is factory-recorded into the memory chip 66, however, so that the printer controller can recognize the printhead type once the cartridge is installed in the printer and thereafter obtain from printer memory any of the above-summarized information that is not otherwise carried in the memory chip.

Figure 3:
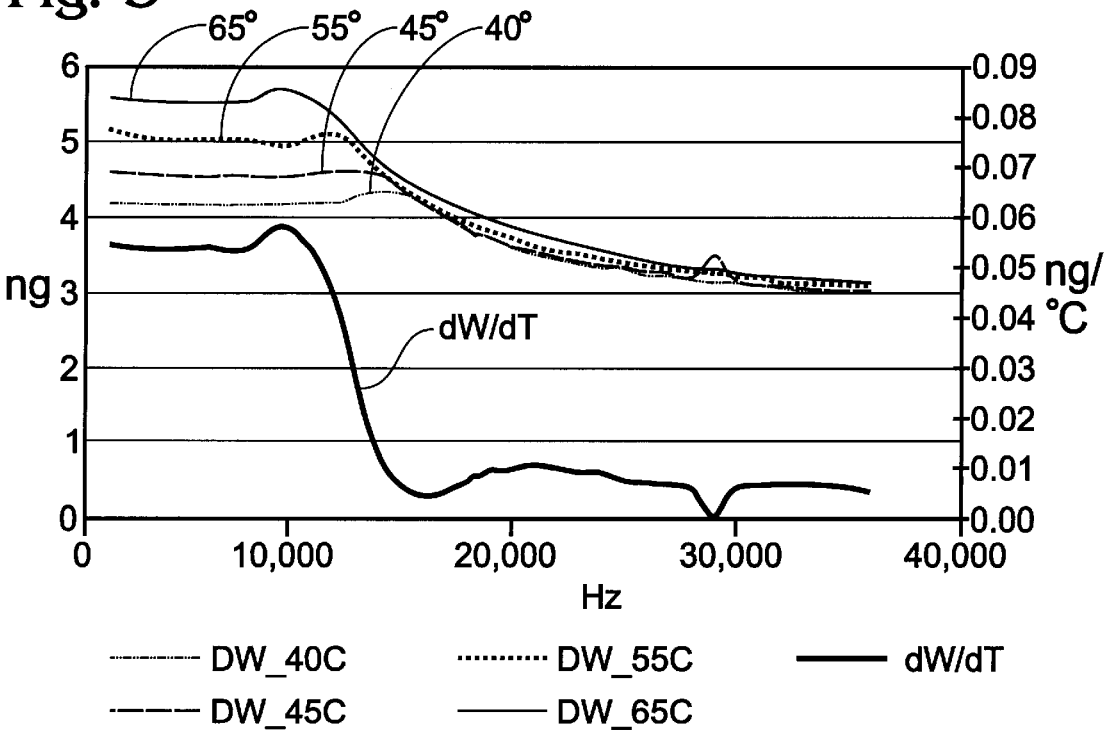
FIG. 3 is a graph illustrating, for one type (color) of ink, empirically derived relationships between printing frequency and drop weight, and between printhead temperature and drop weight, which relationships are used in carrying out the method of the present invention.

Before turning to a detailed description of the preferred method of the present invention, reference is made to FIG. 3, which is a graph illustrating for one type (color) of ink empirically derived relationships between printing frequency and ink drop weight, and between printhead temperature and drop weight.

The plotted set of four lines in the upper part of the graph show, for four different printhead temperatures, how ink drop weight varies for a given average printing frequency. Thus, at a printing frequency of 10,000 Hz, the average drop weight of this ink will vary from about 4.2 nanograms (ng) if the printhead temperature is 40° C. to about 5.6 nanograms if the printhead temperature is 65° C. The lowest plotted curve dW/dT represents this variation in terms of temperature. Thus, at the 10,000 Hz printing frequency, this ink drop weight will change by about 0.057 ng for every one degree variation from a set point temperature, which for this example is 45° C.

Considering the upper four plotted lines along the length of the graph's abscissa, one can see that above about 10,000 Hz printing frequency the average drop weight for this ink gradually reduces as the frequency increases. One can also note that at the high end of the frequency range the four drop-weight curves converge such that the effects of temperature differences are minimized.

The just discussed empirically derived relationships between printing frequency and drop weight, and between printhead temperature and drop weight, for all ink and printhead types, are preferably reduced to look-up tables in the printer memory 44 and referred to in carrying out the method described next.

In accordance with the present invention, ink level gauging of the cartridges is carried out generally using the "drop count" approach mentioned above, while making more precise the relationship between the expelled-drop count and the weight of ink actually expelled. As one aspect of this precision enhancement, a swath is divided (for purposes of this method) into a number of intervals. Drop weight estimates are made for the drops ejected in each interval using temperature and printing frequency data pertaining to each interval. The estimates for each interval are summed for the entire swath to arrive at the overall weight of ink ejected from the print cartridge to the swath. The stored record of the remaining ink in the cartridge is then updated to reflect the depletion of ink and, when appropriate, a low-on-ink or out-of-ink signal is generated for display to the user.

Figure 4A:
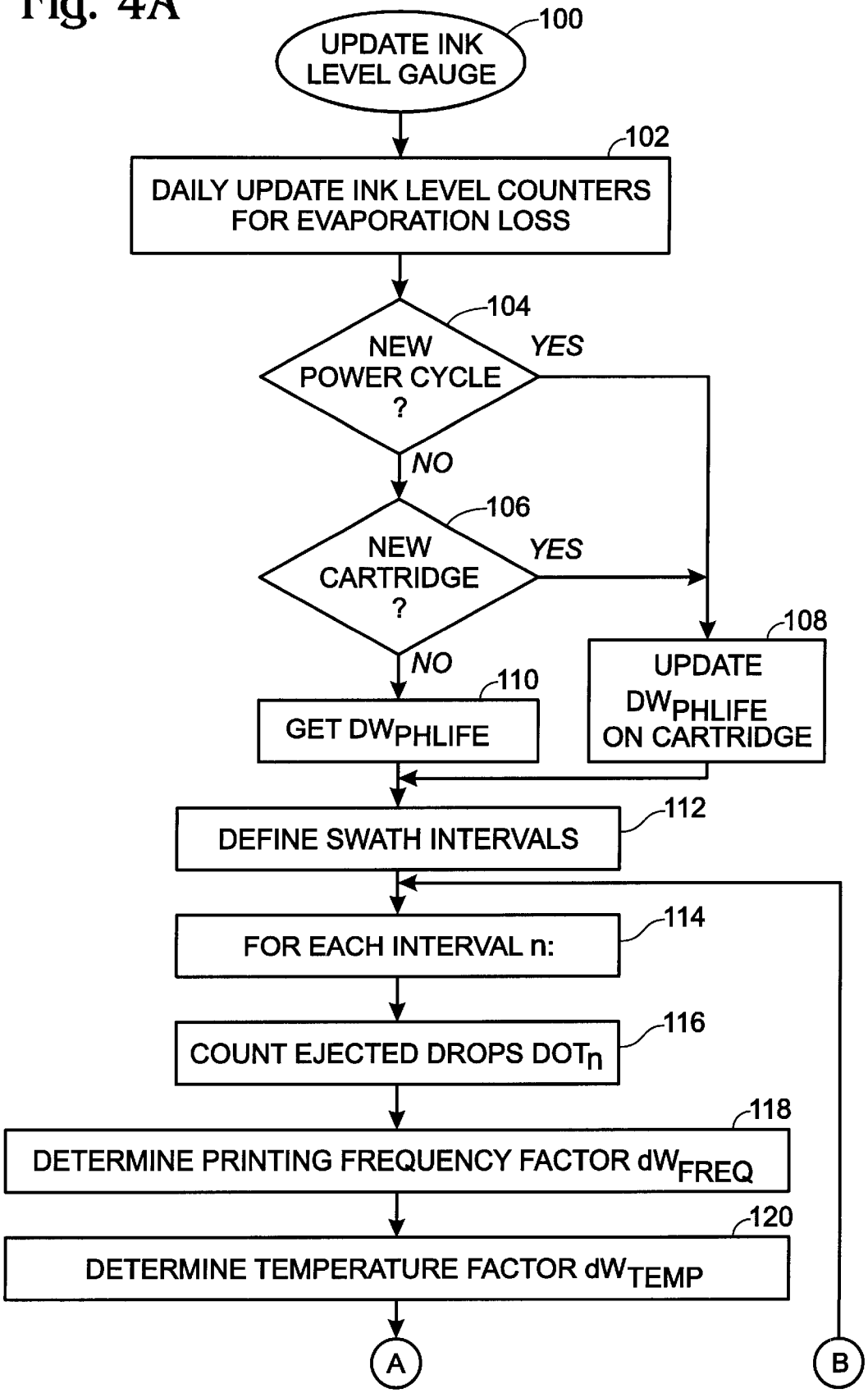
FIGS. 4*a* and 4B provide a high-level flow diagram of the primary steps of the method of the present invention.
Figure 4B:
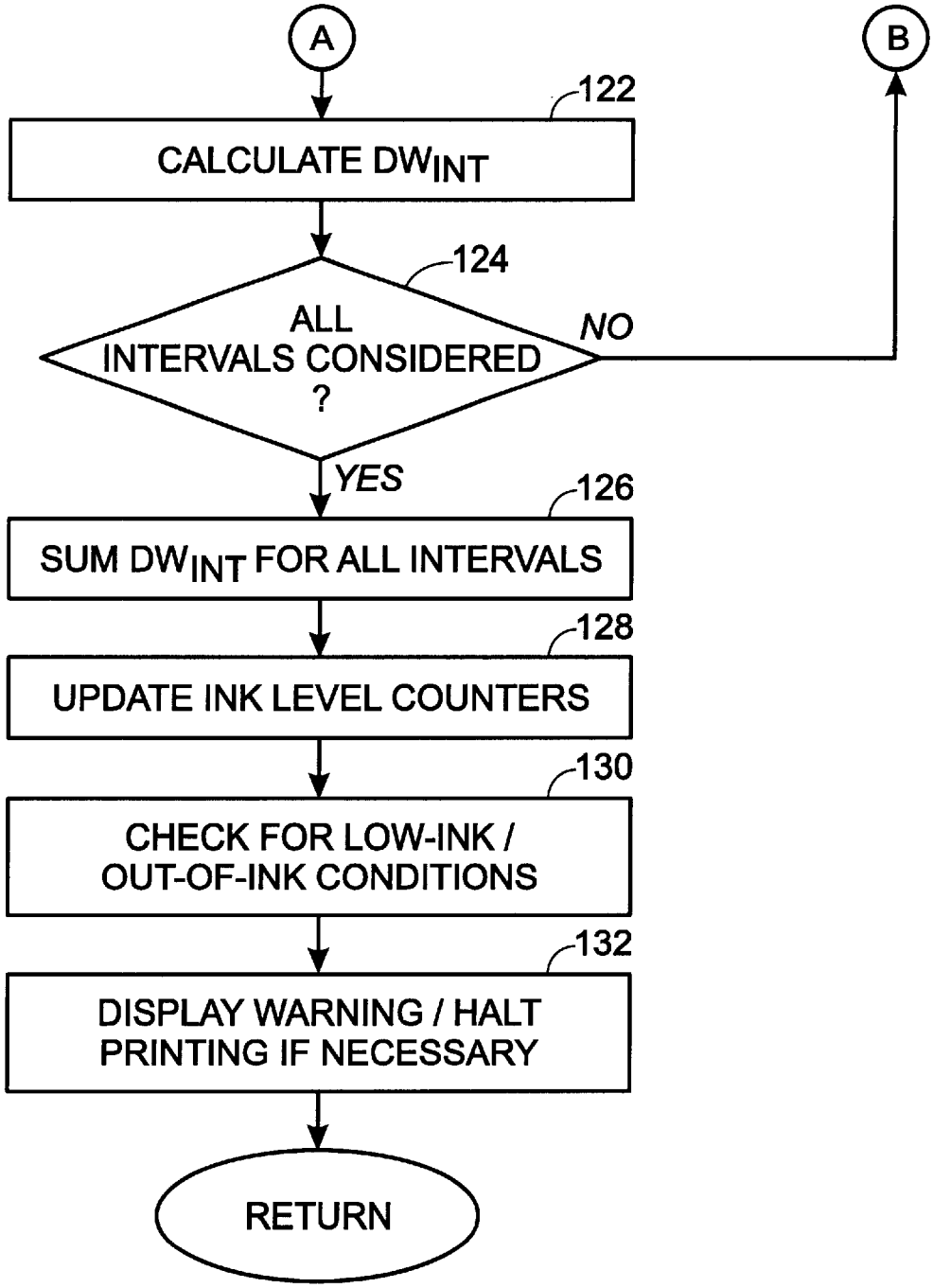

With reference to the flow chart of FIGS. 4*a* and 4*b*, the routine or method carried out under the control of the print controller 40 is designated "Update Ink Level Gauge" 100. The routine is normally carried out once a swath is completely printed, although it can be called at other times as needed.

A first step 102 of the routine is to update ink level counters to reflect evaporation loss. Depending on the characteristics of the cartridge container (its vapor transmission rate) and other factors, such as the humidity and temperature of the operating environment, this step may be optional. Preferably, however, this update is undertaken occasionally, such as once a day or once a week. The number of days since the last such update (stored in printer memory 44 or memory chip 66) is multiplied by a characteristic evaporation rate for the printhead (read from the memory chip 66 for example) to arrive at an amount of ink (measured in units of weight such as nanograms) lost from evaporation. A temperature sensor in the printhead (described below) is consulted while the printhead is not operating (and cooled to ambient) to provide a signal representing the ambient temperature for use in the evaporation-loss calculation.

As noted, part of the memory chip 66 is reserved for two 8-bit counters for storing with the cartridge the changing ink level information. In a preferred embodiment, the 8 bits of one counter are calibrated for use as 8 increments or "ticks" of a course ink-level gauge. For example, for a cartridge that holds 28 grams of ink ("filled weight"), the calibration of the course counter would be 28/8 or 3.5 grams per tick of the counter.

A fine-calibrated 8-bit counter in the memory chip 66 is calibrated by dividing the filled weight by the number of counter ticks ($2^8$). In the 28-gram filled-weight example, this counter would be calibrated to $28/(2^8)$ grams per tick.

Another counter is preferably employed in the printer memory 44 and calibrated for ultra-fine recording of changes in the ink level (i.e., weight). In this regard, a 32 bit ultra-fine counter is calibrated by dividing the filled weight by the number of counter ticks ($2^{32}$). In the 28-gram filled-weight example, this counter would be calibrated to $28/(2^{32})$ grams per tick.

The counters can be configured to count down from filled-weight values or count up to record the amount of depleted ink (which is then subtracted from the filled-weight amount to arrive at a remaining ink amount or "level." In either case, whenever the ink level gauge (i.e., the content of the counters) is to be updated as called for by the present invention, the ultra-fine counter is provided with the product of the change in ink weight and the weight-per-tick calibration of that counter. Each time the ultra-fine counter rolls over, the fine counter is ticked, and each time the fine counter rolls over the course counter is ticked.

Upon completion of any ink-level update step, the controller microprocessor 42 checks the contents of these ink level counters, compares the counter values with low-ink warning trigger levels, and presents the result to the user by, for example changing a multi-bar-type ink level gauge display 76 associated with the printer system.

It is noteworthy here that ink level tracking is carried out for each cartridge, and in the case of a color cartridge, such as cartridge C2, the level of each ink color is also tracked in accordance with the present invention. The printer memory includes an ultra-fine counter for each cartridge's supply of ink. Also, the locations and configurations of the above-described counters for recording these ink levels are described in terms of a preferred embodiment, although it is contemplated that any of a number of means can be employed for recording and maintaining the changes in ink levels.

Returning to FIGS. 4*a–b*, the illustrated steps 104, 106, and 108 of that figure concern the process of updating and average drop weight value that is assigned to each printhead upon manufacture and is preferably recorded in the printer memory 44 or in the memory chip 66 associated with that printhead. This average drop weight, $DW_{PHLIFE}$ is an empirically derived value of the weight (for example, 5 ng) of an average drop of the ink in a given cartridge when fired at a given temperature (say, 45° C.) and at a given printing frequency (say, 10,000 Hz). The average drop weight, however, varies over the life of a printhead. That is, a printhead has a useful life that may be measured in tens of millions of ejected drops and, with other factors being equal, the average drop weight tends to increase during the life of the printhead.

In one preferred embodiment, the variation in drop weight attributable to the use of the printhead is reduced to a look-up table that is consulted by the printer controller each time a new power cycle to the printer is initiated (step 104) or when a new cartridge is installed (step 106). The printer memory 44 or printhead memory chip 66 carries this table as well as a count of the total number of drops fired from the printhead under consideration. The average drop weight $DW_{PHLIFE}$ is then updated 108 (or merely retrieved 110 from memory when updating is not called for).

The average drop weight $DW_{PHLIFE}$ is also adjusted for temperature and printing frequency variations and employed in the calculation to determine the weight of ink ejected from the cartridge as described below. Preferably, this calculation is performed, and the ink level counters (the counters hereafter sometimes collectively referred to as the "ink level gauge," for convenience) are updated after every swath is printed.

In accordance with the present invention, the print swath 25 (FIG. 1) is divided into a number of intervals. Ink weight estimates are made for the drops ejected in each interval using temperature and printing frequency data pertaining to each interval. This swath intervals approach provides a precise estimate of the weight of the ink expelled in the entire swath.

A number of swath intervals are defined (step 112). In a preferred embodiment where, for example, the print media is A4 sized paper, six equal-width intervals may be defined, as illustrated in FIG. 1. The intervals, designated "n" through "n-5," each have the same length "d."

Alternatively, the number of swath intervals could be selected in a manner that results in the highest average interval drop density considering all of the intervals in the swath. To this end, the print data could be scrutinized just before the swath is to be printed. A number of different-sized intervals would be tried, and after each trial the resulting average print density is determined. The interval number trial that provided the greatest average print density is then selected as the interval size.

It is noteworthy here that although the interval size or width "d" is described as parallel to the carriage direction 34, it is contemplated that the swath could also be divided into intervals across its width perpendicular to dimension line 32, or both. In the preferred embodiment of this invention, a predetermined number of uniform intervals are used.

As noted, the ejected-drops weight estimates are made for the drops ejected in each interval (step 114) and later summed for the swath. Thus, the number of ejected drops are "counted" for each interval "n" (step 116). That is, the printer controller 40 includes drop counters 72, 74 for maintaining count of the drops fired from respective cartridges C1, C2. The drop counters 72, 74 do not actually count ink drops. Rather, the microprocessor 42 directs to these counters a stream of input pulses corresponding to the current pulses produced for firing the printhead resistors. Since one current pulse to the resistor produces one fired drop, the input to the drop counters matches the number of drops actually fired. The variable $DOT_n$ represents the number of drops fired for an interval.

The average printing frequency for each interval is also determined to permit calculation of a factor for adjusting the average drop weight to reflect the above-described variations in drop weight with variations in printing frequency. This printing frequency PFREQ is calculated as:

$$PFREQ=DOT_n/(\#NOZMAX*t_d)$$

where #NOZMAX is the maximum number of nozzles extending across the width of the swath ("swath width nozzles") and $t_d$ is the quotient of the interval length "d" and velocity "V" of the carriage 20 as it traverses the interval.

Once the printing frequency is determined for that interval, a look-up table in the printer memory 44 is consulted to determine how the average drop weight $DW_{PHLIFE}$ is to be adjusted to account for the difference between a set point frequency for which the average drop weight was originally determined and the actual printing frequency just calculated for that interval. This adjustment is designated as a frequency factor and assigned variable $dW_{FREQ}$ (step 118).

The average printhead temperature for each interval is also determined for use in calculating the factor for adjusting the average drop weight to reflect the above-described variations in drop weight with variations in printhead temperature. This average temperature is determined by the use of a temperature sensor 70 (see FIG. 2) that is carried on the printhead. Any of a number of temperature sensors can be used.

In one preferred embodiment, the sensor 70 is a thermal sense resistor having a resistance that increases with temperature. The thermal sense resistor is deposited on the printhead in the vicinity of the firing resistors. The thermal sense resistor is intermittently connected with a current source, and its resistance, gain adjusted, is measured by the controller 40 and converted to a corresponding printhead temperature. Preferably, the analog signal proportional to the resistance of the thermal sense resistor 70 is converted to a digital signal by an analog-to-digital converter that is also carried on the printhead.

The temperature is sampled several times during the printing of the interval and then averaged. This average temperature value is then used to reference a look-up table in the controller memory 44 to determine how the average drop weight $DW_{PHLIFE}$ is to be adjusted to account for the difference between the set point temperature for which the average drop weight was originally determined and the actual temperature just sensed for that interval. This adjustment is designated a temperature factor and assigned variable $dW_{TEMP}$ (step 120).

The average drop weight $DW_{INT}$ for each interval is then determined (steps 122, 124). This calculation can be expressed as:

$$DW_{INT}=DOT_N(DW_{PHLIFE}+dW_{FREQ}+dW_{TEMP}).$$

It will be appreciated that by merely multiplying the number of fired drops by an average drop weight will yield a "gross" weight of ink ejected. The average drop weight $DW_{INT}$ calculated above represents a refinement or "net" weight of ejected ink that accounts for the frequency, temperature, and printhead life factors as discussed earlier.

The average drop weight for the entire swath is then determined as the sum of these values $DW_{INT}$ for all intervals (step 126). The ink level counters (gauge) are then updated as described above (step 128). The resulting ink level amount is displayed to the user via display 76 (FIG. 2).

In the event that any low-ink triggers or thresholds are crossed when the ink level is updated (step 130), the gauge display is supplemented with suitable visual and/or audible warnings that are produced by the controller 40 (step 132). If an out-of-ink condition is reached, printing is halted and the cartridge "limps home," as discussed above, printing its reserve ink to complete the page or swath and reach a service station in the printer.

With the enhanced accuracy provided by the ink level gauging of the present invention, a printing system may accurately predict for a user how many more pages may be printed for a given supply. To this end, the printer controller records or otherwise statistically determines the average ink usage per page. This information is compared with (divided by) the ink level data in the updated counters to obtain an estimate the number of pages that can be printed before changing the present supply. This estimate is provided to the user as another component of the ink level gauge display 76.

Having here described preferred embodiments of the present invention, it is anticipated that suitable modifications may be made thereto by individuals skilled in the art within the scope of the invention. For example, it is contemplated that any of a number of ways could be used to quantify the temperature or printing frequency factors described above. Thus, it is intended that the term "factor" means any value determined by any technique for the purpose of adjusting the average drop weight to account for changes due to printhead temperature fluctuations or to firing frequency changes.

The present algorithm would also be called upon when non-printing ink ejection occurs, such as when ink is fired from the printhead to clear nozzles while the cartridge is in the printer service station. Also, the method could be employed with piezoelectric type printheads. Moreover, it is contemplated that the printer system discussed above could be part of a facsimile machine, plotter, or any other inkjet recording device.

Thus, although preferred and alternative embodiments of the present invention have been described, it will be appreciated by one of ordinary skill in this art that the spirit and scope of the invention is not limited to those embodiments, but extend to the various modifications and equivalents as defined in the appended claims.

What is claimed is:

1. A method of determining the amount of ink ejected from the printhead of an inkjet print cartridge that is controlled for ejecting ink drops, the method comprising the steps of:

determining the number of ejected drops;

selecting an average drop weight;

multiplying the number of ejected drops by the average drop weight to obtain a gross weight;

providing a frequency factor relating to the frequency with which the drops are ejected; and adjusting the gross weight by the frequency factor to arrive at a net weight of the amount of ink ejected.

2. The method claim 1 including the step of adjusting the gross weight by a temperature factor corresponding to the temperature of the ink drops that are ejected.

3. The method of claim 1 wherein the selecting step includes the step of accounting for variations in the average drop weight caused by the amount of use of the printhead.

4. The method of claim 1 including the step of storing on the cartridge ink level information that is based upon the net weight of the amount of ink ejected.

5. The method of claim 4 further including the steps of obtaining from the cartridge information that corresponds to the weight of the ink in the cartridge and calibrating a counter to relate increments of the counter to an incremental amount of the weight of the ink.

6. The method of claim 4 including the step of altering the information stored on the cartridge to account for ink that evaporates from the cartridge.

7. The method of claim 1 wherein the printhead is controlled for ejecting ink drops along a swath that is traversed by the printhead and that extends from one side of a print medium to another side of the medium, and wherein the method of claim 1 is carried out for each of several discrete intervals of the swath.

8. The method of claim 7 wherein the number of drops ejected within an interval of the swath defines an interval drop density, the method including the step of selecting the number of swath intervals in a manner that results in the highest average interval drop density considering all of the intervals in the swath.

9. The method of claim 7 including the step of determining for each interval of the swath the average temperature of the printhead as the printhead traverses the interval.

10. The method claim 7 wherein the providing step includes calculating for each interval a frequency with which the drops are ejected by the printhead as the printhead traverses the interval.

11. A method of determining the amount of ink ejected from the printhead of an inkjet print cartridge that is controlled for ejecting ink drops as the printhead traverses a swath, the method comprising the steps of:

determining the number of ejected drops in each of at least two intervals of the swath;

selecting an average drop weight;

multiplying the number of ejected drops in each interval by the average drop weight to obtain a gross weight for each interval;

providing temperature factors relating to the temperature of the printhead as the printhead traverses each interval, thereby to provide a temperature factor associated with each interval; and adjusting the obtained gross weights for each interval by the associated temperature factors and summing to arrive at a net weight of the amount of ink ejected within the swath.

12. The method of claim 11 including the steps of:

providing frequency factors relating to the frequency with which the drops are ejected as the printhead traverses each interval, thereby to provide a frequency factor associated with each interval; and adjusting the obtained gross weights for each interval by the associated frequency factors before summing to arrive at a net weight of the amount of ink ejected within the swath.

13. The method of claim 11 including the step of establishing a number of swath intervals by determining the density of drops ejected by the printhead within the swath.

14. The method of claim 11 including:

accounting for ink depletion attributable to evaporation from the cartridge; and then recording the amount of ink remaining in the cartridge.

15. The method of claim 14 wherein the printhead operation heats the printhead above ambient temperature and wherein the accounting step includes sensing the temperature of the printhead during a time that the printhead is not operating so that the sensed temperature will substantially match ambient temperature.

16. A method of calculating the weight of ink ejected by a printhead of an inkjet print cartridge as the cartridge traverses a swath, comprising the steps of:

dividing the swath into intervals;

determining for each interval the temperature of the printhead as the printhead traverses the interval;

calculating for each interval the weight of the ink ejected as a function of the determined temperatures; and summing the calculated weights.

17. The method of claim 16 wherein the calculating step for one of the intervals includes:

determining the number of drops ejected within that interval to arrive at a gross weight of drops for that interval; and adjusting that gross weight by a factor relating to the average frequency with which the drops are ejected by the printhead during that interval.

18. The method of claim 17 further comprising the step of adjusting the gross weight of drops for that interval by a factor relating to the number of drops that had been ejected from the printhead before traversing the swath.

19. The method of claim 16 wherein the number of drops ejected in an interval of the swath area defines a drop density, the method including the step of selecting the number of swath intervals in a manner that results in the highest average interval drop density considering all of the intervals in the swath.

20. The method of claim 16 including the step of storing on the cartridge information relating to the weight of ink ejected and to an amount of ink lost by evaporation.

* * * * *